US006236027B1

(12) United States Patent
Miyata et al.

(10) Patent No.: US 6,236,027 B1
(45) Date of Patent: May 22, 2001

(54) CERAMIC HEATER

(75) Inventors: Fumishige Miyata; Masahiro Tsuji, both of Gifu (JP)

(73) Assignee: Ibiden Co., Ltd., Gifu (JP)

( * ) Notice: Subject to any disclaimer, the term of this patent is extended or adjusted under 35 U.S.C. 154(b) by 0 days.

(21) Appl. No.: 09/534,541

(22) Filed: Mar. 27, 2000

(30) Foreign Application Priority Data

Mar. 26, 1999 (JP) ..... 11-084078
Mar. 31, 1999 (JP) ..... 11-090834

(51) Int. Cl.[7] ..... H05B 3/06

(52) U.S. Cl. ..... 219/542; 219/270; 219/546; 219/548

(58) Field of Search ..... 219/270, 505, 219/552–554, 544, 548, 543; 338/226; 29/611; 501/97.1, 97.2, 97.3, 97.4

(56) References Cited

U.S. PATENT DOCUMENTS 5,451,748 * 9/1995 Matsuzaki et al. ..... 219/543
5,948,306 * 9/1999 Konishi et al. ..... 219/548
6,049,065 * 4/2000 Konishi ..... 219/270

* cited by examiner

*Primary Examiner*—Tu Ba Hoang
(74) *Attorney, Agent, or Firm*—Sughrue, Mion, Zinn, Macpeak & Seas, PLLC

(57) ABSTRACT

This invention provides a ceramic heater comprising a core, an insulation layer and a resistance heating element of high-melting metal as embedded between the core and insulation layer, wherein the operating temperature is not less than 300° C., the insulation layer comprising a sintered compact composed of 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO and having a density of not less than 3.60 and a thickness of 100 to 300 $\mu$m.

4 Claims, 6 Drawing Sheets

CERAMIC HEATER

FIELD OF THE INVENTION

The present invention relates to a cylindrical ceramic heater comprising a resistance heating element embedded in ceramics.

BACKGROUND OF THE INVENTION

The compact cylindrical ceramic heater comprising a resistance heating element of high-melting metal as embedded between a core and an insulation layer covering the core is in widespread use as a heating means for the automotive oxygen sensor, glow system, etc. or as a heat source for devices for gassification of petroleum oil, such as a heater for use in semiconductor heating or an oil fan heater.

FIG. 6(*a*) is a perspective view showing a typical ceramic heater of this type schematically and FIG. 6(*b*) is a sectional view taken along the line A—A of Fig. (a).

This ceramic heater comprises a cylindrical core 31, an insulation layer 32 wrapping around said core 31 with an adhesive layer 37 interposed, and a resistance heating element 33 embedded between said core and insulation layer, with terminal portions of said resistance heating element 33 being connected to external terminals 34 disposed externally of said insulation layer 32 and lead wires 36 being connected to said external terminals 34, respectively.

As shown in FIG. 6(*b*), each terminal portion of said resistance heating element 33 and the corresponding external terminal 34 are interconnected via a plated-through hole 35 provided in the insulation layer 32 beneath the external terminal 34. In this arrangement, as an electric current is applied between the external terminals 34 through the lead wires 36, the resistance heating element 33 generates heat and thereby functions as a heater.

The insulation layer 32 of said ceramic heater generally comprises $Al_2O_3$ supplemented with, as sintering aids, $SiO_2$, MgO, CaO, etc. and, for such insulation layer, compaction to the theoretical density is difficult at the usual sintering temperature. Moreover, depending on characteristics of the starting material $Al_2O_3$ powder, the particle size distribution of said sintering aids, and impurities, the ultimate density is sometimes more or less lower than a set density value.

In addition, as heating is continued for a long time, the alumina ceramics forming the insulation layer 32 is degraded by grain boundary migration etc. to develop voids in some cases.

In such cases, the resistance heating element 33 embedded in the alumina ceramics is oxidized to suffer a progressive increase in resistance and the resistance heating element 33 as such undergoes expansion at times. Moreover, as the oxidation of the resistance heating element 33 progresses, its heating temperature is altered and, in addition, the element 33 becomes easily destroyed and, in extreme cases, develop a disconnection trouble.

Moreover, because the resistance heating element usually comprises a high-melting metal and the metal and the ceramics are widely different in the coefficient of thermal expansion, the repeated heating load on the ceramic heater induces cracks across the interface between the resistance heating element and the ceramics owing to the thermal stress, resulting in local destruction of the ceramic heater and a disconnection in the resistance heating element.

SUMMARY OF THE INVENTION

In the above state of the art, the present invention has for its object to provide a durable ceramic heater which is not only protected against the oxidation of its resistance heating element on prolonged operation of the heater and the consequent change in the resistance heating element but also against heater degradation due to aging and is free from the risks for cracking and other troubles due to the difference in thermal expansion coefficient between the resistance heating element and the insulation layer or the core.

The present invention is concerned, in a first aspect, with a ceramic heater comprising a core, an insulation layer and a resistance heating element of high-melting metal as embedded between said core and insulation layer, wherein the operating temperature is not less than 300° C. and said insulation layer comprises a sintered compact composed of 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO and having a density of not less than 3.60 and a thickness of 100 to 300 $\mu$m.

The present invention is further concerned, in a second aspect, with a ceramic heater comprising a core, an insulation layer and a resistance heating element of high-melting metal as embedded between said core and insulation layer, said insulation layer comprising a sintered compact composed of 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO and having a density ratio of not less than 96% and an average thermal expansion coefficient of $6\times10^{-6}$ to $8\times10^{-6}$° C.$^{-1}$ at room temperature to 1000° C., said resistance heating element comprising a metal composite composed of 92 to 99 weight % of a high-melting metal component and the remainder of a ceramic component and having an average thickness of not less than 15 $\mu$m in the area where the operating temperature reaches 300° C. or higher and an average thermal expansion coefficient of $3.6\times10^{-6}$ to $7.0\times10^{-6}$° C.$^{-1}$ at room temperature to 1000° C., and the ratio of the difference in the average thermal expansion coefficient at room temperature to 1000° C. between said insulation layer and said resistance heating element to the average thermal expansion coefficient of the insulation layer being not greater than 40%.

EXPLANATION OF THE NUMERIC SYMBOLS

Figure 1A:
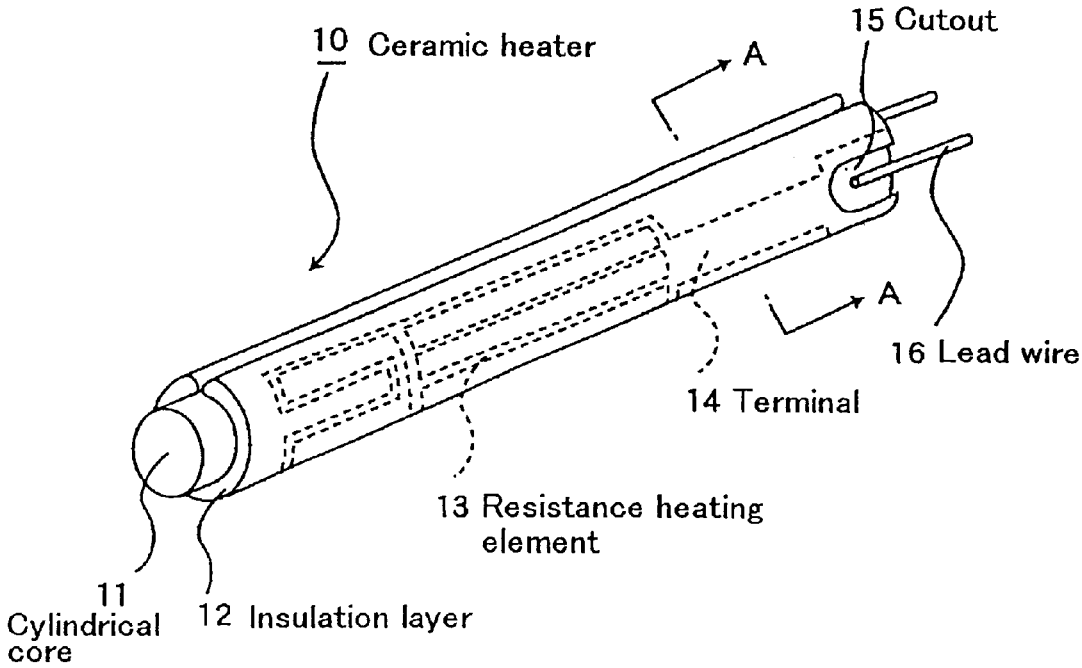
FIG. 1(*a*) is a perspective view showing the construction of a ceramic heater of the invention and FIG. 1(*b*) is a sectional view of the same.

10. ceramic heater
11. cylindrical core
12. insulation layer
13. resistance heating element
14. terminals
15. cutout
16. a lead wire

DETAILED DESCRIPTION OF THE INVENTION

The present invention is now described in detail.

First, the ceramic heater according to the first aspect of the present invention is described.

This ceramic heater has an operating temperature of not less than 300° C. and comprises a core, an insulation layer and a resistance heating element of high-melting metal, said insulation layer comprising a sintered compact composed of 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO and having a density of not less than 3.60 and a thickness of 100 to 300 μm.

Figure 1B:
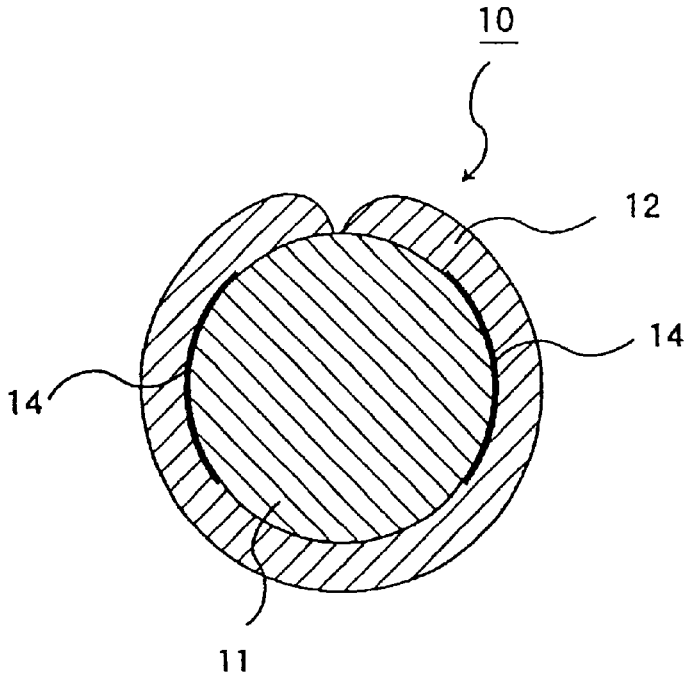

FIG. 1(*a*) is a perspective view showing the ceramic heater according to the first aspect of the invention schematically and FIG. 1(*b*) is a sectional view taken along the line A—A of FIG. 1(*a*).

As illustrated in FIG. 1, this ceramic heater, indicated at 10, comprises a cylindrical core 11, a resistance heating element 13 and terminals 14 as disposed on its surface, and an insulation layer 12 covering said resistance heating element 13 and terminals 14.

Each of said terminals 14 is exposed through a cutout 15 formed in said insulation layer 12 and a lead wire 16 is connected and soldered to the exposed part of the terminal 14.

The insulation layer 12 comprises an alumina ceramic composed of 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO and the core 11 also comprises substantially the same material.

Inclusion of $SiO_2$, MgO and CaO as sintering aids at the above-mentioned amounts in the insulation layer 12 and core 11 is intended to insure the formation of a sintered compact having a given uniform compaction without increasing the sintering temperature for the alumina ceramic to an excessive degree.

Since the operating temperature of this ceramic heater 10 is not less than 300° C., it is necessary that the density and thickness of the insulation layer 12 should be not less than 3.60 and 100 to 300 μm, respectively.

Thus, when the operating temperature of a ceramic heater 10 is higher than 300° C., the resistance heating element 13 will be oxidized, if it is exposed to air, to have its resistance increased. Therefore, the insulation layer 12 should comprise a void-free alumina ceramic having a density of not less than 3.60.

If the density of the insulation layer 12 is less than 3.60, the resistance heating element 13 will be oxided on prolonged use of the ceramic heater 10 to have its resistance value increased and such changes in resistance of the resistance heating element 13 will alter the heating temperature of the heater 10. Moreover, as the oxidation further progresses, the resistance heating element 13 may develop a disconnection trouble.

Moreover, if the thickness of the insulation layer 12 is less than 100 μm, the resistance heating element 13 will be oxidized on prolonged use of the ceramic heater 10 to have its resistance increased, with the result that the heating temperature of the heater 10 will be altered. On the other hand, if the thickness of the insulation layer 12 is greater than 300 μm, the insulation layer 12 acts as a heat insulation so that the heater temperature will be decreased.

The mean grain size of the alumina ceramic constituting the insulation layer 12 is preferably about 3.0 to 7.0 μm. Therefore, the mean particle diameter of the alumina powder for use in the sintering operation is preferably about 2.0 to 5.0 μm.

When the operating temperature of the ceramic heater 10 is set at a still higher temperature of not less than 800° C., the density and thickness of the insulation layer 13 should be 3.60 or higher and 150 to 300 μm, respectively.

If the density of the insulation layer 12 is less than 3.60, prolonged use of the ceramic heater 10 results in oxidation of the resistance heating element 13 and consequent increase in its resistance value and, on account of such changes in resistance of the resistance heating element 13, the heater temperature will be altered.

If the thickness of the insulation layer 12 is less than 150 μm, prolonged use of the ceramic heater 10 will result in formation of voids due to migration of the Mg and Ca segregated in grain boundaries and the consequent oxidation of the resistance heating element 13 will result in increased resistance. On the other hand, if the thickness of the insulation layer 12 exceeds 300 μm, the insulation layer 12 acts as a heat insulation because of its excessive thickness, thus making it difficult to maintain the heater temperature at 800° C. or higher.

The high-melting metal forming the resistance heating element 13 may for example be W, Ta, Nb or Ti. These metals may be used independently or in a combination of two or more species. Among these metals, W is preferred. Any of those metals supplemented with Mo or Re is also useful. The high-melting metal may also contain at least one member selected from among $Al_2O_3$, mullite and silicon nitride in a minor proportion. These ceramics may be used each alone or in a combination of two or more species.

The process for fabricating the above ceramic heater according to the first aspect of the invention is now described.

FIGS. 2 through 5 are schematic views showing the flow of production of the ceramic heater 10. In each figure, (a) represents a sectional view and (b) represents a plan view.

Figure 2A:
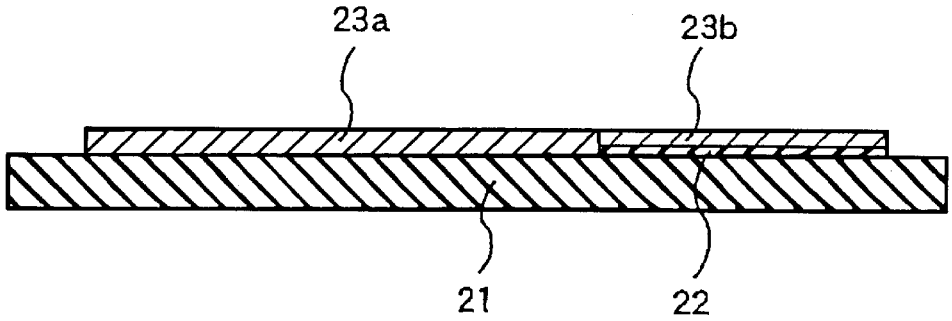
FIG. 2(*a*) is a schematic sectional view showing a stage in the fabrication of a ceramic heater according to the invention and FIG. 2(*b*) is a plan view of the same.
Figure 2B:
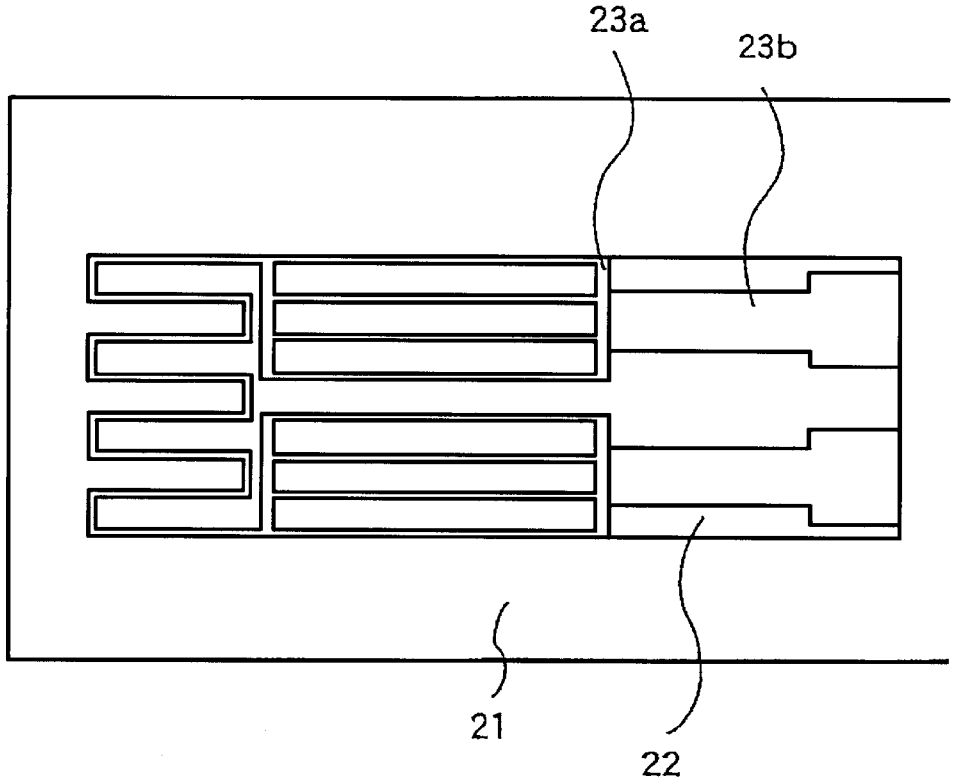

As illustrated in FIG. 2, an adhesive layer 22 is first formed on a releasable plastic film 21 and, then, a conductor paste layer 23*a* forming said resistance heating element 13 and a conductor paste layer 23*b* forming said terminals 14 are constructed.

The adhesive layer 22 is constructed in order that, in the fabrication of the heater, the parts of terminals 14 to be exposed through the cutouts 15 may be firmly secured to the core 11. Moreover, the conductor paste layer 23*a* and conductor paste layer 23*b* are disposed one adjoining the other so that they may be firmly secured to each other.

Figure 3A:
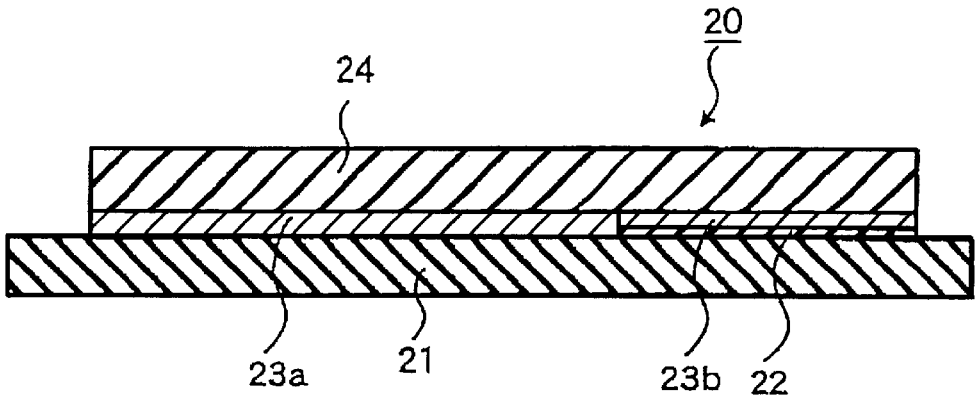
FIG. 3(*a*) is a schematic sectional view showing a further stage in the fabrication of a ceramic heater according to the invention and FIG. 3(*b*) is a plan view of the same.
Figure 3B:
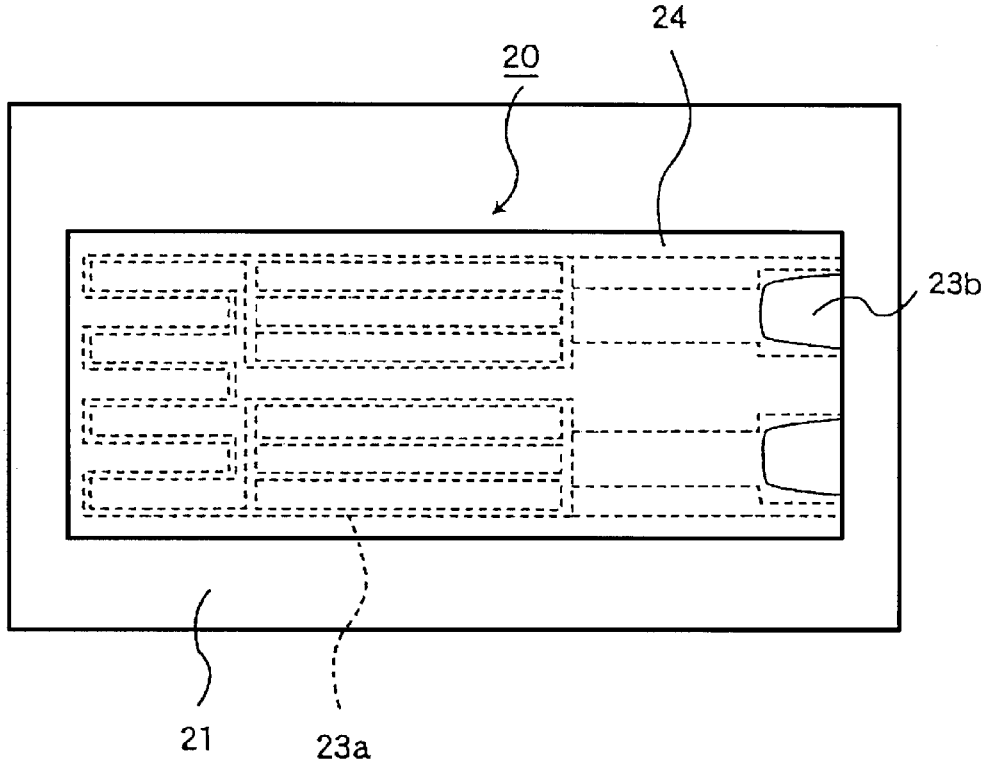

Then, as shown in FIG. 3, a green sheet layer 24 for said insulation layer 12 is formed to cover the conductor paste layer 23*a* and conductor paste layer 23*b*.

However, the parts of conductor paste layer 23*b* corresponding to the cutouts 15 to be formed after firing of the green sheet layer 24 are not covered with the green sheet layer 24 but kept exposed.

Figure 4A:
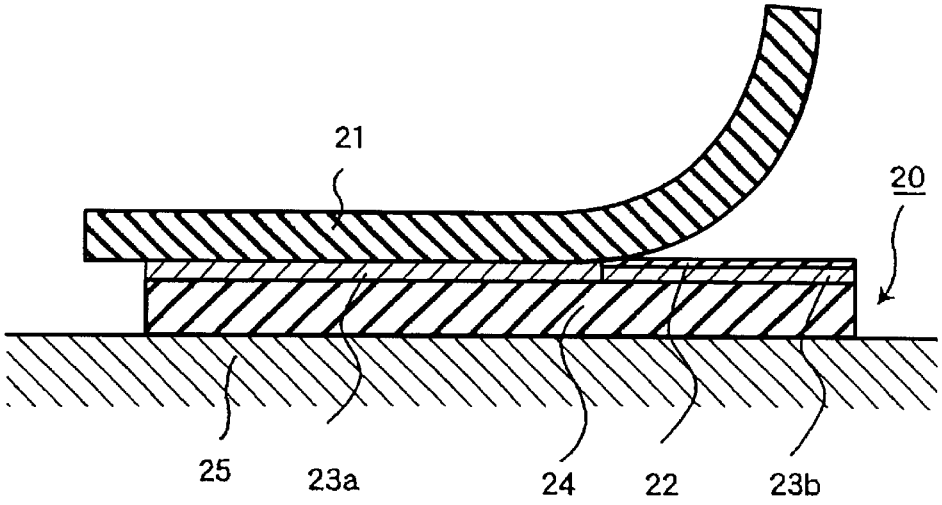
FIG. 4(*a*) is a schematic sectional view showing a still further stage in the fabrication of a ceramic heater according to the invention and FIG. 4(*b*) is a plan view of the same.
Figure 4B:
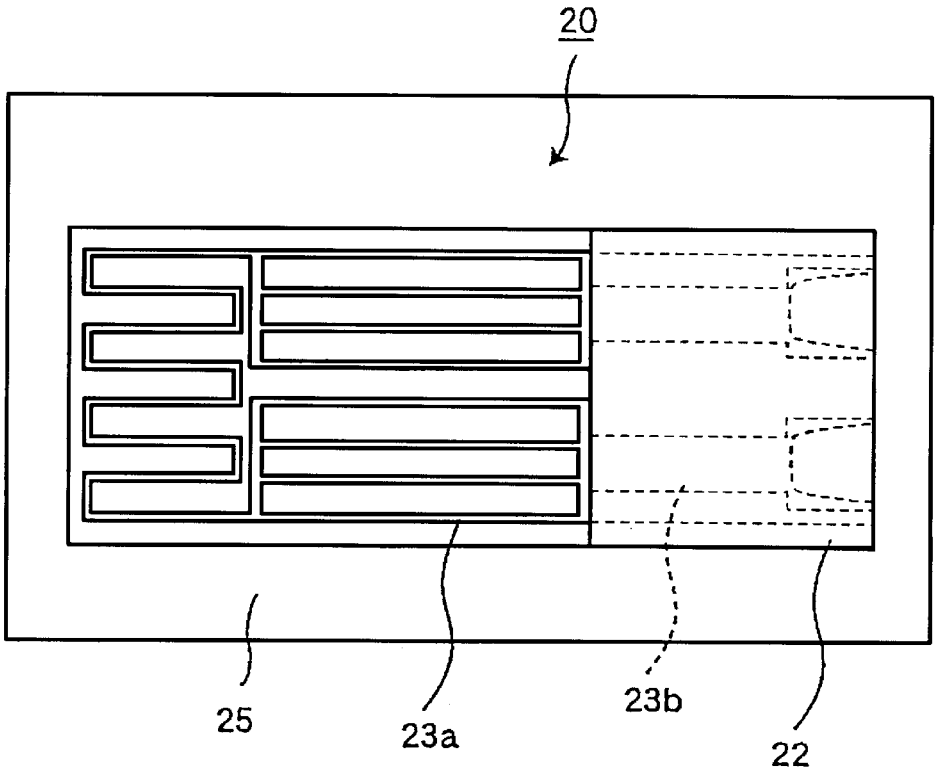

Then, as illustrated in FIG. 4, the laminate 20 is turned back so that the green sheet 24 will become the underside and set rigidly on a platform 25, for example by means of the air suction applied from through-holes (not shown) formed in the platform 25. Then, a plastic film 21 is peeled off.

Figure 5A:
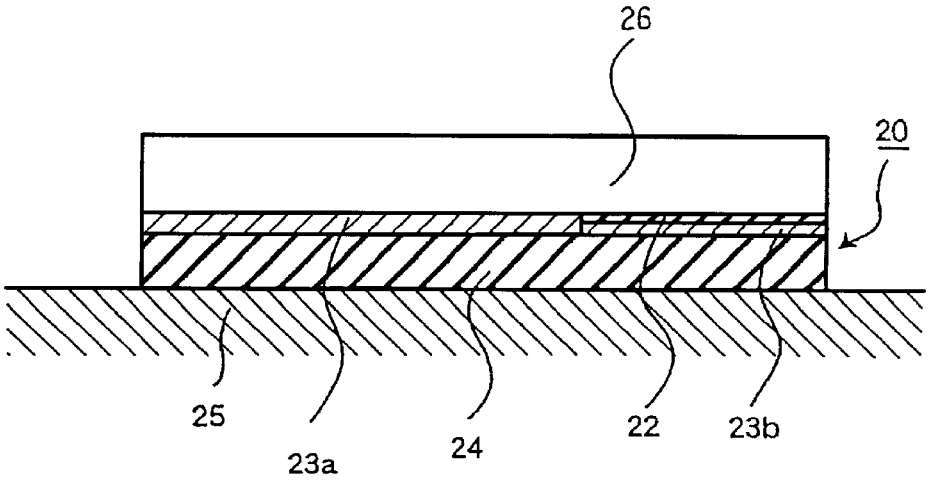
FIG. 5(*a*) is a schematic sectional view showing a further stage in the fabrication of a ceramic heater according to the invention and FIG. 5(*b*) is a plan view of the same.
Figure 5B:
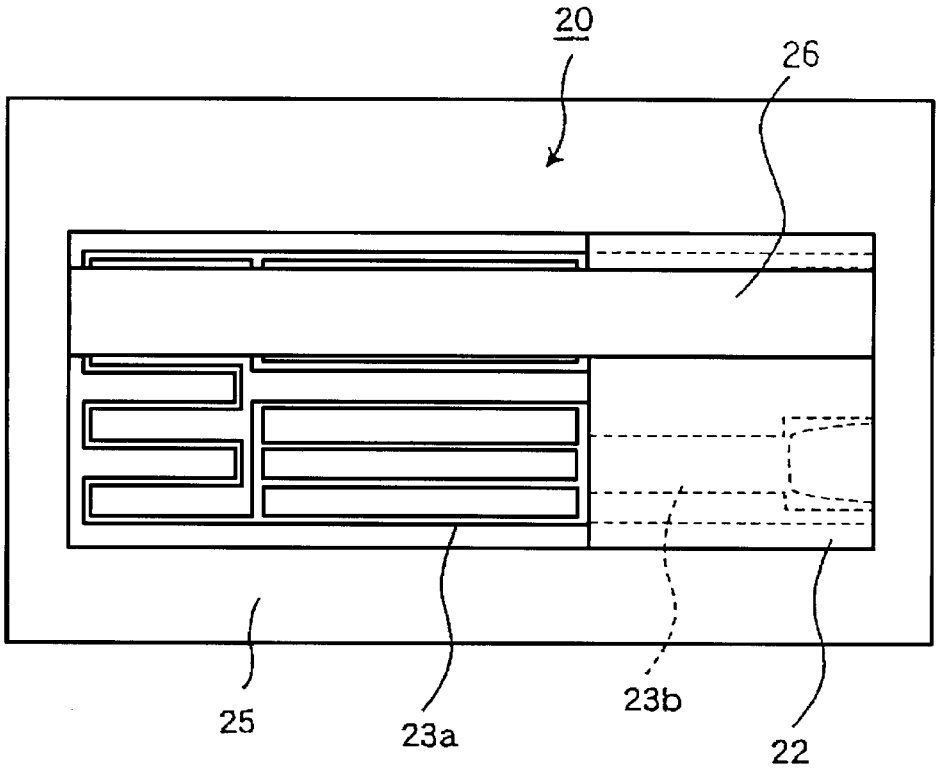
Figure 6A:
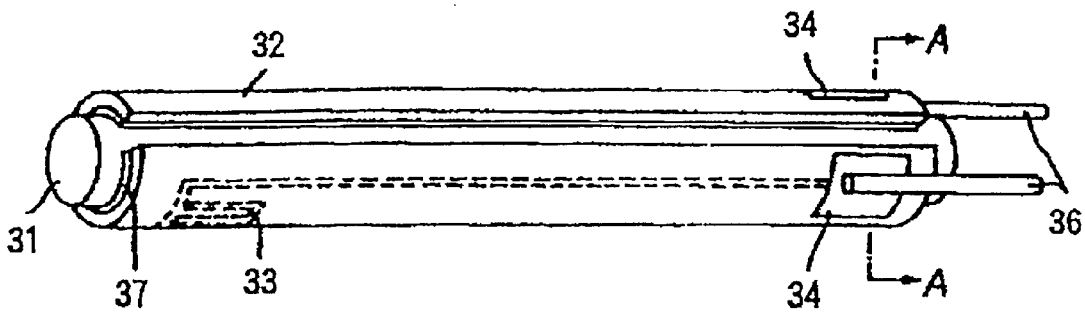
FIG. 6(a) PRIOR ART
FIG. 6(*a*) is a perspective view showing the construction of a conventional ceramic heater and FIG. 6(*b*) is a sectional view of the same.
Figure 6B:
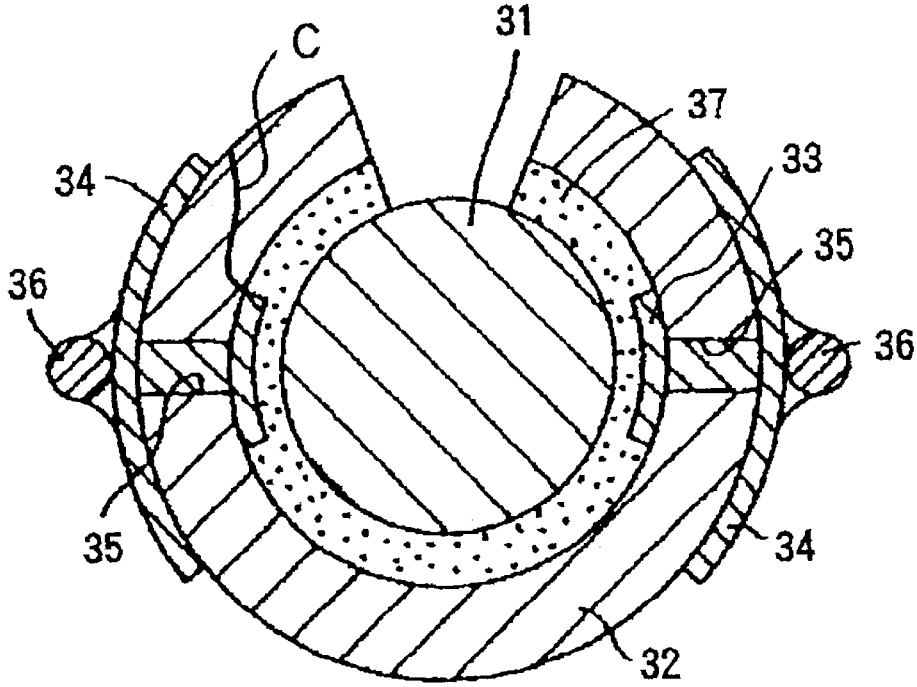
FIG. 6(b) PRIOR ART

Then, as illustrated in FIG. 5, a cylindrical piece 26 for use as the core 11 is placed on the laminate 20 which is then wrapped around said cylindrical piece 26 to construct a green molding for firing. This green molding is sintered at a predetermined temperature to provide the ceramic heater 10.

In the ceramic heater 10 thus fabricated, the resistance heating element 13 is covered with the insulation layer 12 having a density of not less than 3.60 and a thickness of 100 to 300 $\mu$m so that the resistance heating element 13 is well protected from exposure to external air. Thus, the resistance heating element 13 will hardly be oxidized even if a current flows through the ceramic heater 10 for many consecutive hours or the ceramic heater 10 is used at a temperature over 300° C., with the result that the change in resistance of the resistance heating element 13 due to such oxidation and the degradation of the heater by aging can be successfully prevented.

The ceramic heater according to the second aspect of the invention is now described.

The ceramic heater according to the second aspect of the invention comprises a core, an insulation layer, and a resistance heating element of high-melting metal as embedded between said core and insulation layer, said insulation layer comprising a sintered compact composed of 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO and having a density ratio of not less than 96% and an average thermal expansion coefficient of $6\times10^{-6}$ to $8\times10^{-6}$° C.$^{-1}$ at room temperature to 1000° C., said resistance heating element comprising a metal composite composed of 92 to 99 weight % of a high-melting metal component and the remainder of a ceramic component and having an average thickness of not less than 15 $\mu$m in the area where the operating temperature reaches 300° C. or higher and an average thermal expansion coefficient of $3.6\times10^{-6}$ to $7.0\times10^{-6}$° C. at room temperature to 1000° C., and the ratio of the difference in the average thermal expansion coefficient at room temperature to 1000° C. between said insulation layer and resistance heating element to the average thermal expansion coefficient of said insulation layer being not greater than 40%.

The insulation layer of this ceramic heater according to the second aspect of the invention is composed of 88 to 95 weight % of $Al_2O_3$ supplemented with, sintering aids, 3 to 10 weight % of $SiO_2$, 0.4 to 1.0 weight % of MgO and 1.0 to 2.5 weight % of CaO just as in the ceramic heater according to the first aspect of the invention.

The density ratio of this insulation layer is not less than 96% and the average thermal expansion coefficient of the layer is $6\times10^{-6}$ to $8\times10^{-6}$° C.$^{-1}$. The core 11 also comprises substantially the same material.

Since the ceramic heater according to the second aspect of the invention is structurally similar to the ceramic heater according to the first aspect of the invention which is shown in FIG. 1, its structure is not described.

As in the ceramic heater according to the first aspect of the invention, the insulation layer and core contain $SiO_2$, MgO, etc. at said amounts as sintering aids.

If the density ratio of said insulation layer is less than 96%, the probability of existence of voids will be high and the grain boundaries of the alumina ceramic constituting said insulation layer will be degraded by migration etc. to increase the risk for void formation, with the result that the resisting heating element will be liable to undergo oxidation as the ceramic heater is used over a long period of time.

The term "density ratio" as used herein means the percentage of the actual density of the sintered compact based on the theoretical density of the particular ceramic body.

If the average thermal expansion coefficient of the insulation layer is less than $6\times10^{-6}$° C.$^{-1}$, the ratio of the difference in average thermal expansion coefficient between the layer and the resistance heating element to the average thermal expansion coefficient of the insulation layer will exceed 40%, with the result that the insulation layer will be liable to develop cracks. On the other hand, if the average thermal expansion coefficient of the insulation layer exceeds $8\times10^{-6}$° C.$^{-1}$, it will be difficult to provide an alumina ceramic having such a physical characteristic.

The ratio of the difference in thermal expansion coefficient between the insulation layer and the resistance heating element to the average thermal expansion coefficient of said insulation layer can be expressed by the following expression (1).

$$[(\text{average thermal expansion coefficient of resistance heating element} - \text{average thermal expansion coefficient of insulation layer})\times100]/(\text{average thermal expansion coefficient of insulation layer}) \quad (1)$$

In the following description, the ratio expressed by the above expression (1) will be referred to briefly as "the difference in average thermal expansion coefficient between insulation layer and resistance heating element".

On the other hand, the resistance heating element comprises a metal composite composed of 92 to 99 weight % of a high-melting metal component and the remainder of a ceramic component and having an average thickness of not less than 15 $\mu$m in the area where the operating temperature reaches 300° C. or higher and an average thermal expansion coefficient of $3.6\times10^{-6}$ to $6.0\times10^{-6}$° C.$^{-1}$.

The high-melting metal mentioned above includes the same metals as those mentioned hereinbefore in connection with the ceramic heater according to the first aspect of the present invention.

A conductor paste containing a mixture of said high-melting metal and said ceramic component is coated and fired to form a metal composite. Since the average thermal expansion coefficient can be varied according to the formulation of the metal composite, the thermal expansion coefficient of the resistance heating element can be adjusted.

The average thickness of said resistance heating element in the area where the operating temperature reaches 300° C. or higher is set to be not less than 15 $\mu$m as mentioned hereinbefore. This is because, if the thickness of this resistance heating element is less than 15 $\mu$m, surface oxidation of the resistance heating element will result in a greater proportion of the oxidized layer relative to the whole element so that the resistance value of the resistance heating element will be altered or the disconnection trouble due to degradation tends to take place.

If it is attempted to fabricate a resistance heating element with an average thermal expansion coefficient of less than $3.6\times10^{-6}$° C.$^{-1}$, it will become necessary to increase the proportion of the ceramic component but the resistance value will then be increased. On the other hand, if the coefficient exceeds $6.0\times10^{-6}$° C.$^{-1}$, the difference in thermal expansion coefficient between resistance heating element and insulation layer will exceed 40%, with the result that cracks may at times be induced in the insulation layer.

Furthermore, the difference in average thermal expansion coefficient between insulation layer and resistance heating element must not be greater than 40%.

If the difference in average thermal expansion coefficient between the two members is greater than 40%, the resistance heating element expanding as the result of temperature buildup may compress the insulation layer to induce cracks therein due to the difference in thermal expansion coefficient.

Since the process for fabricating the ceramic heater according to the second aspect of the invention is similar to the process for fabricating the ceramic heater according to the first aspect of the invention, a description of the process is omitted.

Since, in the ceramic heater according to the second aspect of the invention, the insulation layer is comprised of a sintered compact having the high density and the thermal expansion coefficient mentioned above, the resistance heating element is comprised of a metal composite having the thermal expansion coefficient mentioned above, and the difference in thermal expansion coefficient between the insulation layer and resistance heating element is not greater than 40%, the resistance heating element is not oxidized even when the ceramic heater is used over a long time, with the result that the ceramic heater is durable enough without the risk for cracks due to the difference in thermal expansion coefficient between the resistance heating element and the insulation layer or the core.

BEST MODES FOR CURRYING OUT THE INVENTION

The following examples are further illustrative of the present invention but by no means limitative of the scope of the invention.

EXAMPLE 1

In accordance with the process described in detail above, the ceramic heater 10 shown in FIG. 1 was fabricated. The sintering temperature used was 1600° C. The resistance heating element 13 of the ceramic heater 10 thus fabricated was composed of 80 weight % of W, 17 weight % of Re and 3 weight % of $Al_2O_3$ and the insulation layer 12 was composed of 92.5 weight % of $Al_2O_3$ supplemented with, as sintering aids, 5.8 weight % of $SiO_2$, 0.5 weight % of MgO and 1.2 weight % of CaO and had a thickness of 200 $\mu$m and a density of 3.70.

The ceramic heater 10 thus fabricated was connected to a 12 V DC source, whereupon the heater temperature rose to 900° C. in 15 seconds. The current supply to the ceramic heater 10 was further continued and the time to a 10% change in resistance was measured. The time was 9000 hours.

The percent change in resistance can be expressed by the following expression (1).

$$\text{Change in resistance (\%)}=[(\text{resistance value after test}-\text{resistance value before test})\times100]/(\text{resistance value before test}) \quad (1)$$

COMPARATIVE EXAMPLE 1

Except that the thickness of the insulation layer was altered, the procedure of Example 1 was otherwise repeated to fabricate a ceramic heater. The sintering temperature was 1600° C. The material formulation for the resistance heating element of the ceramic heater was the same as that used in Example 1, and the insulation layer was composed of 92.5 weight % of $Al_2O_3$ supplemented with, as sintering aids, 5.8 weight % of $SiO_2$, 0.5 weight % of MgO and 1.2 weight % of CaO and had a thickness of 80 $\mu$m and a density of 3.70.

The ceramic heater thus obtained was connected to a 12 V DC source, whereupon the heater temperature rose to 900° C. The current supply to the ceramic heater was further continued and the time to a 10% change in resistance was measured. The time was found to be 6000 hours.

COMPARATIVE EXAMPLE 2

Except that the thickness of the insulation layer was altered, the procedure of Example 1 was otherwise repeated to fabricate a ceramic heater. The sintering temperature used was 1600° C. The material formulation for the resistance heating element of the ceramic heater thus fabricated was the same as that used in Example 1 and the insulation layer was composed of 92.5 weight % of $Al_2O_3$ supplemented with, as sintering aids, 5.8 weight % of $SiO_2$, 0.5 weight % of MgO and 1.2 weight % of CaO and had a thickness of 350 $\mu$m and a density of 3.70.

The ceramic heater thus fabricated was connected to a 12 V DC source for calorification but the heater temperature was slow to reach 900° C. and the time to 900° C. was 1.0 minute.

COMPARATIVE EXAMPLE 3

Except that the density and thickness of the insulation layer were altered, the procedure of Example 1 was otherwise repeated to fabricate a ceramic heater. The sintering temperature used was 1500° C. The material formulation for the resistance heating element of the ceramic heater thus fabricated was the same as that used in Example 1, and the insulation layer was composed of 85 weight % of $Al_2O_3$ supplemented with, as sintering aids, 12 weight % of $SiO_2$, 1.0 weight % of MgO and 2.0 weight % of CaO and had a thickness of 200 $\mu$m and a density of 3.55.

The ceramic heater thus fabricated was connected to a 12 V DC source for calorification, whereupon the heater temperature rose to 900° C. The ceramic heater was further supplied with the current and the time to a 10% change in resistance was measured. The time was 5000 hours.

It will be apparent from the foregoing data relating to change in resistance in Example 1 and Comparative Examples 1 to 3 that the resistance change of the resistance heating element could be effectively inhibited by setting the density of the insulation layer at not less than 3.60 and the thickness thereof between 100 and 300 $\mu$m.

EXAMPLE 2

In accordance with the process described hereinbefore, a ceramic heater 10 of the construction illustrated in FIG. 1 was fabricated. The sintering temperature used was 1600° C. The insulation layer 12 of this ceramic heater 10 was composed of 92.5 weight % of $Al_2O_3$ supplemented with, as sintering aids, 5.8 weight % of $SiO_2$, 0.5 weight % of MgO and 1.2 weight % of CaO and had a thickness of 200 $\mu$m, a density ratio of 97% and an average thermal expansion coefficient of $6.9\times10^{-6}$° C.$^{-1}$.

The resistance heating element 13 was composed of 80 weight % of W, 17 weight % of Re and 3 weight % of $Al_2O_3$ and had an average thermal expansion coefficient of $4.5\times10^{-6}$° C.$^{-1}$. The average thickness of the element in the area where the operating temperature reached 300° C. or higher was 25 $\mu$m.

Therefore, the difference in average thermal expansion coefficient between the insulation layer and the resistance heating element was 34.8%.

One of two ceramic heaters 10 fabricated under identical conditions was connected to a 12 V DC source for calorification, whereupon the heater temperature rose to 900° C. Then, this heater 10 was subjected to a heat cycle test comprising 100 cycles of room temperature and 500° C. and the surface and interior of the heater were examined but no cracks were found.

The other ceramic heater 10 was consistently supplied with the current and the time to a 10% change in resistance was measured. The time was found to be 10000 hours.

EXAMPLES 3 AND 4

Except that the composition of the green sheet and that of the conductor paste were altered, the procedure of Example 2 was otherwise followed to fabricate ceramic heaters 10 having the characteristics shown in Table 1.

The characteristics of the insulation layer and resistance heating element comprising each ceramic heater thus fabricated and the difference in average thermal expansion coefficient between insulation layer and resistance heating element are shown below in Table 1. The result of the heat cycle test and the time to a resistance change of 10% are shown below in Table 2.

COMPARATIVE EXAMPLES 4 AND 5

Except that the composition of the green sheet and that of the conductor paste were altered, the procedure of Example 1 was otherwise followed to fabricate ceramic heaters having the characteristics shown in Table 1.

The characteristics of the insulation layer and resistance heating element of each ceramic heater thus fabricated and the difference in average thermal expansion coefficient between insulation layer and resistance heating element are shown in Table 1. The result of the heat cycle test and the time to a resistance change of 10% are shown in Table 2.

Table 1

| | Insulation layer | | | | | | Resistance heating element | | | | Difference in Average |
|---|---|---|---|---|---|---|---|---|---|---|---|
| | Composition | | | | Density | Average thermal expansion | Composition | | | Average thermal expansion | thermal expansion coefficient |
| | $Al_2O_3$ | $SiO_2$ | MgO | CaO | ratio | coefficient (° C.$^{-1}$) | W | Re | $Al_2O_3$ | coefficient (° C.$^{-1}$) | (%) |
| Ex. 2 | 92.5 | 5.8 | 0.5 | 1.2 | 97.0 | $6.9\times10^{-6}$ | 80 | 17 | 3 | $4.5\times10^{-6}$ | 34.8 |
| Ex. 3 | 94.0 | 4.0 | 0.5 | 1.5 | 97.5 | $7.0\times10^{-6}$ | 92 | 5 | 3 | $4.4\times10^{-6}$ | 37.1 |
| Ex. 4 | 95.0 | 3.6 | 0.4 | 1.0 | 98.0 | $7.1\times10^{-6}$ | 82 | 15 | 3 | $4.5\times10^{-6}$ | 36.6 |
| Compar. Ex. 4 | 99.9 | 0.08 | 0.01 | 0.01 | 99 | $8.1\times10^{-6}$ | 80 | 17 | 3 | $4.5\times10^{-6}$ | 44.4 |
| Compar. Ex. 5 | 85 | 11.2 | 1.1 | 2.7 | 94 | $5.9\times10^{-6}$ | 80 | 17 | 3 | $4.5\times10^{-6}$ | 23.7 |

| | Results of Heat cycle test | Results of Resistance change test (hr) |
|---|---|---|
| Ex. 2 | No cracks | 10000 |
| Ex. 3 | No cracks | 9000 |
| Ex. 4 | No cracks | 9500 |
| Compar. Ex. 4 | Microcracks formed | 6000 |
| Compar. Ex. 5 | No cracks | 4000 |

It will be apparent from Table 2 showing the results of resistance change tests in Examples 2 to 4 and Comparative Examples 4 and 5 that whereas the heaters of Comparative Examples 4 and 5 developed cracks or the resistance heating element was oxidized in a short period of time, the heaters of Examples 2 to 4 did not develop cracks even on repeated thermal loading and were effectively suppressed in the resistance change of the resistance heating element even when the heater was used for a long time.

Having the constitution described above, the ceramic heater according to the first aspect of the present invention is advantageous in that because the resistance heating element is hardly oxidized even when the heater is used for a long time, it is protected not only against resistance change of the resistance heating element but also against degradation due to aging.

In the ceramic heater according to the second aspect of the present invention, because of the construction of which has been described above, the resistance heating element is not oxidized even when the heater is used for a long time and the heater is free from the risk for cracking due to the difference in thermal expansion coefficient between the resistance heating element and the insulation layer or the core, thus enjoing a long useful life.

What is claimed is:

1. A ceramic heater comprising a core, an insulation layer and a resistance heating element of high-melting metal as embedded between said core and insulation layer, wherein the operating temperature is not less than 300° C. and said insulation layer comprises a sintered compact composed of 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO and having a density of not less than 3.60 and a thickness of 100 to 300 $\mu$m.

2. The ceramic heater according to claim 1, wherein the operating temperature is not less than 800° C. and the insulation layer has a thickness of 150 to 300 $\mu$m.

3. A ceramic heater comprising a core, an insulation layer and a resistance heating element of high-melting metal as embedded between said core and insulation layer, said insulation layer comprising a sintered compact composed of 88 to 95 weight % of $Al_2O_3$ supplemented with, as sintering aids, 3 to 10 weight % of $SiO_2$, 0.4 to 1.0 weight % of MgO and 1.0 to 2.5 weight % of CaO and having a density ratio of not less than 96% and an average thermal expansion coefficient of $6\times10^{-6}$ to $8\times10^{-6}$° C.$^{-1}$ at room temperature to 1000° C., said resistance heating element comprising a metal composite composed of 92 to 99 weight % of a high-melting metal component and the remainder of a ceramic component and having an average thickness of not less than 15 $\mu$m in the area where the operating temperature reaches 300° C. or higher and an average thermal expansion coefficient of $3.6\times10^{-6}$ to $7.0\times10^{-6}$° C.$^{-1}$ at room temperature to 1000° C., and the ratio of the difference in average thermal expansion coefficient at room temperature to 1000° C. between said insulation layer and said resistance heating element to the average thermal expansion coefficient of the insulation layer being not greater than 40%.

4. The ceramic heater according to any of claims 1 to 3 wherein the high-melting metal component is at least one member selected from the group consisting of W, Ta, Nb and Ti or the same member supplemented with Mo or Re and the ceramic component is at least one member selected from the group consisting of $Al_2O_3$, mullite and silicon nitride.

* * * * *